US008373608B2

(12) United States Patent
Drexler et al.

(10) Patent No.: US 8,373,608 B2
(45) Date of Patent: Feb. 12, 2013

(54) RECONFIGURABLE ANTENNA PATTERN VERIFICATION

(75) Inventors: Jerome P. Drexler, Wyoming, MN (US); Robert C. Becker, Eden Prairie, MN (US); David W. Meyers, Brooklyn Park, MN (US); Kelly P. Muldoon, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 1468 days.

(21) Appl. No.: 11/951,023

(22) Filed: Dec. 5, 2007

(65) Prior Publication Data

US 2009/0146895 A1 Jun. 11, 2009

(51) Int. Cl.
*H01Q 3/00* (2006.01)

(52) U.S. Cl. ..... 343/757; 342/368

(58) Field of Classification Search ..... 343/703, 343/700 MS, 757, 760, 876; 342/173, 174, 342/368

See application file for complete search history.

(56) References Cited

U.S. PATENT DOCUMENTS

| | | | | |
|---|---|---|---|---|
| 5,719,794 | A | 2/1998 | Altshuler et al. | |
| 6,107,975 | A | 8/2000 | Brennan et al. | |
| 6,323,809 | B1 | 11/2001 | Maloney et al. | |
| 6,384,797 | B1 | 5/2002 | Schaffner et al. | |
| 6,469,677 | B1 | 10/2002 | Schaffner et al. | |
| 6,774,844 | B2 | 8/2004 | Subotic et al. | |
| 6,876,337 | B2 | 4/2005 | Larry | |
| 6,985,109 | B2 * | 1/2006 | Lust et al. | 343/700 MS |
| 2005/0088358 | A1 | 4/2005 | Larry et al. | |
| 2005/0164640 | A1 * | 7/2005 | Nagy | 455/63.4 |
| 2007/0084987 | A1 | 4/2007 | Bauhahn et al. | |
| 2007/0180338 | A1 | 8/2007 | Becker et al. | |

FOREIGN PATENT DOCUMENTS

| | | |
|---|---|---|
| EP | 1511119 | 3/2005 |
| EP | 1870960 | 12/2007 |
| KR | 100735319 | 6/2007 |
| WO | 2005069437 | 7/2005 |
| WO | 2007086966 | 8/2007 |

OTHER PUBLICATIONS

Pringle et al., "A Reconfigurable Aperture Antenna Based on Switched Links Between Electrically Small Metallic Patches", "IEEE Transactions on Antennas and Propagation", Jun. 2004, pp. 1434-1445, vol. 52, No. 6, Publisher: IEEE.

Schaffner et al., "Reconfigurable Aperture Antennas Using RF MEMS Switches for Multi-Octave Tunability and Beam Steering", "IEEE Antennas and Propagation Society International Symposium", 2000, pp. 321-324, vol. 1, Publisher: IEEE.

Vanblaricum, "A Brief History of Photonic Antenna Reconfiguration", "International Topical Metting on Microwave Photonics MWP 2000, Technical Digest", Sep. 11, 2000, pp. 9-12, Publisher: IEEE.

Schaffner et al., "Reconfigurable Aperture Antennas Using RF MEMS Switches for Multi-Octave Tunability and Beam Steering", "IEEE Antennas and Propagation Society International Symposium", Jul. 16, 2000, pp. 321-324, vol. 1, Publisher: IEEE.

European Patent Office, "European Search Report", May 11, 2009, Published in: EP.

* cited by examiner

*Primary Examiner* — Robert Karacsony
(74) *Attorney, Agent, or Firm* — Fogg & Powers LLC

(57) ABSTRACT

A method of verifying programmable antenna configurations is disclosed. The method comprises selecting a desired antenna configuration from a plurality of antenna configuration patterns, with the selected antenna configuration forming at least one reconfigurable antenna from reconfigurable antenna array elements. The method validates the formation of the selected antenna configuration to determine antenna performance of the at least one reconfigurable antenna.

20 Claims, 4 Drawing Sheets

RECONFIGURABLE ANTENNA PATTERN VERIFICATION

GOVERNMENT INTEREST STATEMENT

The U.S. Government may have certain rights in the present invention as provided for by the terms of Government Contract No. R-700-200451-20053/NASA: NNC04AA44A awarded by the Ohio Aerospace Institute/NASA GLENN.

CROSS REFERENCE TO RELATED APPLICATION

This application is related to commonly assigned U.S. patent application Ser. No. 11/951,018, filed on even date herewith and entitled "RECONFIGURABLE ANTENNA STEERING PATTERNS" (the '018 Application). The '018 Application is incorporated herein by reference.

BACKGROUND

The use of modeling in the design of antennas is known. Typically, antenna designers use classic Euclidean geometry (for example, simple squares, circles, and triangles) to design the shape of an antenna and its components (also known as antenna "elements") to obtain certain antenna characteristics. For example, the antenna designer will use a combination of shapes to control the antenna signal beam shape, also known as the antenna pattern or radiation pattern. This use of combinations of antenna elements and shapes to obtain desired antenna characteristics is typically referred to as antenna beam steering or beam shaping. Geometric antennas usually have well defined, fixed characteristics.

Reconfigurable antennas represent a class of antenna that normally does not have a specific characteristic. Instead, this class of antennas require configuration before they are usable. Reconfigurable antennas can operate over large frequency ranges and can be beam-steered without the use of multiple radiating elements and phase shifters as are found in a phased array type of antenna. In addition, this class of antenna does not generate grating lobes like a phased array antenna because the radiation source is a continuous element instead of a multiplicity of individual elements.

Reconfigurable antennas can accommodate a wide variety of specifications, such as beam width, operating frequency, and radiation angle. The difficulty with an antenna of this type is to determine a configuration that offers the desired performance based on a particular set of requirements and ensure that the configuration of the antenna is the desired configuration. At present, configurable antennas do not verify the configuration.

SUMMARY

The following specification discloses reconfigurable antenna pattern verification for reconfigurable antenna arrays. This summary is made by way of example and not by way of limitation. It is merely provided to aid the reader in understanding some aspects of at least one embodiment described in the following specification.

Particularly, in one embodiment, a method of verifying programmable antenna configurations is provided. The method comprises selecting a desired antenna configuration from a plurality of antenna configuration patterns, with the selected antenna configuration forming at least one reconfigurable antenna from reconfigurable antenna array elements.

The method validates the formation of the selected antenna configuration to determine antenna performance of the at least one reconfigurable antenna.

DRAWINGS

These and other features, aspects, and advantages are better understood with regard to the following description, appended claims, and accompanying drawings where:

The various described features are drawn to emphasize features relevant to the embodiments disclosed. Like reference characters denote like elements throughout the figures and text of the specification.

DETAILED DESCRIPTION

Embodiments disclosed herein relate to reconfigurable antenna elements and antenna configuration patterns that comprise at least one method of antenna signal output verification. In at least one embodiment, an electronic system for antenna configuration pattern verification provides antenna steering and pattern generation modules operable to configure individual antenna elements to form the antenna configuration patterns discussed here. For example, the system directs a programmable controller unit to send commands to an array of switches to configure a particular antenna beam pattern. Moreover, the beam pattern configuration forms at least one reconfigurable antenna having a known radiation beam pattern. Accordingly, at least one steering pattern can be developed for each reconfigurable antenna due to differences in radio-frequency (RF) propagation characteristics of each of the antenna configuration patterns.

For example, the antenna steering module for the antenna configuration pattern verification system discussed above configures the individual antenna array elements to form each of the antenna configuration patterns. The antenna steering module issues commands to the antenna array switches to form the steerable antenna with a known radiation beam shape at a particular frequency. In one implementation, the antenna steering module selects a configuration of switches that steers the antenna configuration patterns formed in the reconfigurable antenna array to resonate in a desired direction and frequency.

In at least one embodiment, the antenna steering module further comprises an antenna steering verification module operable to test and verify the combination of switch positions. The antenna steering verification module verifies that the reconfigurable antenna array produces the correct antenna configuration pattern before the antenna is used. In one implementation, a comparison can be made between the desired or "programmed" configuration against the actual "sensed" configuration to determine that the antenna is steered as desired and ready to use.

Figure 1:
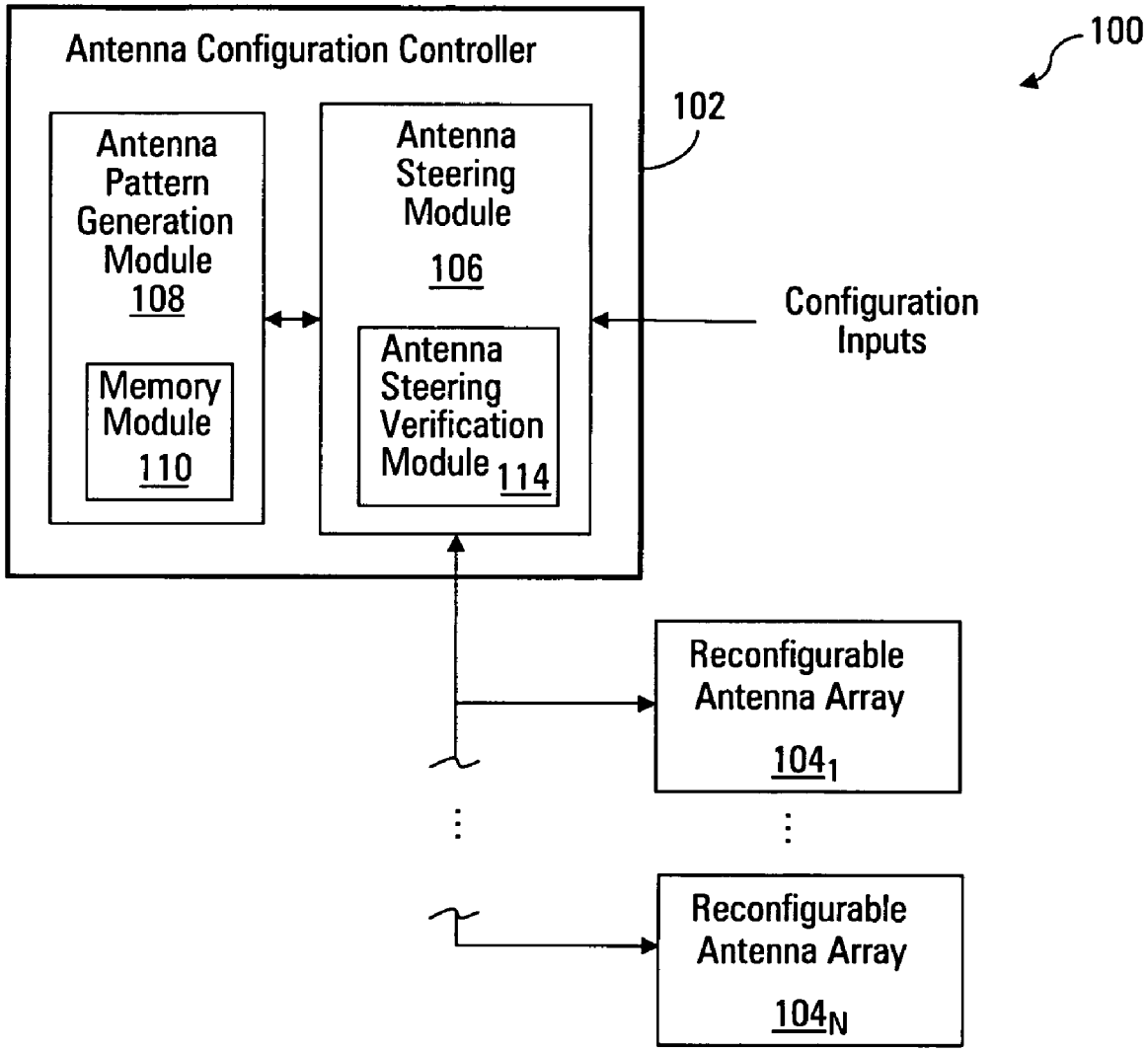
FIG. 1 is a block diagram of an embodiment of an electronic system for antenna configuration pattern verification.

FIG. 1 is a block diagram of an embodiment of an electronic system 100 for antenna configuration pattern verification. The system 100 comprises an antenna configuration controller 102 and at least one reconfigurable antenna array 104 communicatively coupled to the antenna configuration controller 102. In one implementation, the antenna configuration controller 102 comprises an antenna steering module 106 and an antenna pattern generation module 108. In the example embodiment of FIG. 1, the antenna pattern generation module 108 further comprises a memory module 110, and the antenna steering module 106 further comprises an antenna steering verification module 114. In one implementation, the memory unit 110 is a portion of (that is, resides within) the antenna pattern generation module 108, and the at least one reconfigurable antenna array 104 is in direct communication with the antenna steering module 106. In the same and at least one alternate implementation, the antenna configuration controller 102 comprises a microprocessor, a microcontroller, a field-programmable gate array (FPGA), a field-programmable object array (FPOA), a programmable logic device (PLD), an application-specific integrated circuit (ASIC), or the like. It is understood that the system 100 is capable of accommodating any appropriate number of reconfigurable antenna arrays 104 (for example, a plurality of reconfigurable antenna arrays $\mathbf{104}_1$ to $\mathbf{104}_N$) in a single system 100. The composition of the at least one reconfigurable antenna array 104 is discussed in further detail below with respect to FIGS. 2 and 3.

In operation, the antenna configuration controller 102 monitors and validates operation of the programmable elements of each of the reconfigurable antenna arrays 104 based on a desired radiation pattern to determine antenna performance. In the example embodiment of FIG. 1, the antenna configuration controller 102 receives one or more antenna configuration input commands as shown in FIG. 1. In one implementation, the desired radiation pattern is based on an antenna signal beam output requested by the one or more programmable antenna configuration inputs.

In one embodiment, the antenna configuration controller 102 instructs the system 100 to form at least one antenna configuration pattern using at least one of the reconfigurable antenna arrays 104. The antenna configuration controller 102 loads the at least one antenna configuration pattern configured to provide a prescribed signal beam strength for the antenna signal beam output at a desired frequency. For example, the antenna pattern generation module 108 provides a plurality of previously-identified programmable antenna configuration patterns based on the at least one antenna configuration pattern requested by the antenna configuration controller 102. In the same example, the antenna steering module 106 loads the at least one antenna configuration pattern on at least one of the reconfigurable antenna arrays 104.

In the example embodiment of FIG. 1, the antenna steering verification module 114 verifies the at least one antenna configuration pattern formed by the reconfigurable antenna array 104. In one implementation, the antenna steering verification module 114 detects a configuration state of configured pad elements of the reconfigurable antenna array 104, where the configuration state is indicative of an energy threshold level for the configured pad elements. The antenna steering verification module 114 compares the energy levels at a plurality of switches adjacent to the configured pad elements of the reconfigurable antenna array 104 to verify that the monitored antenna configuration pattern is substantially functional as the at least one antenna configuration pattern, as further discussed below with respect to FIGS. 2 and 3.

Figure 2:
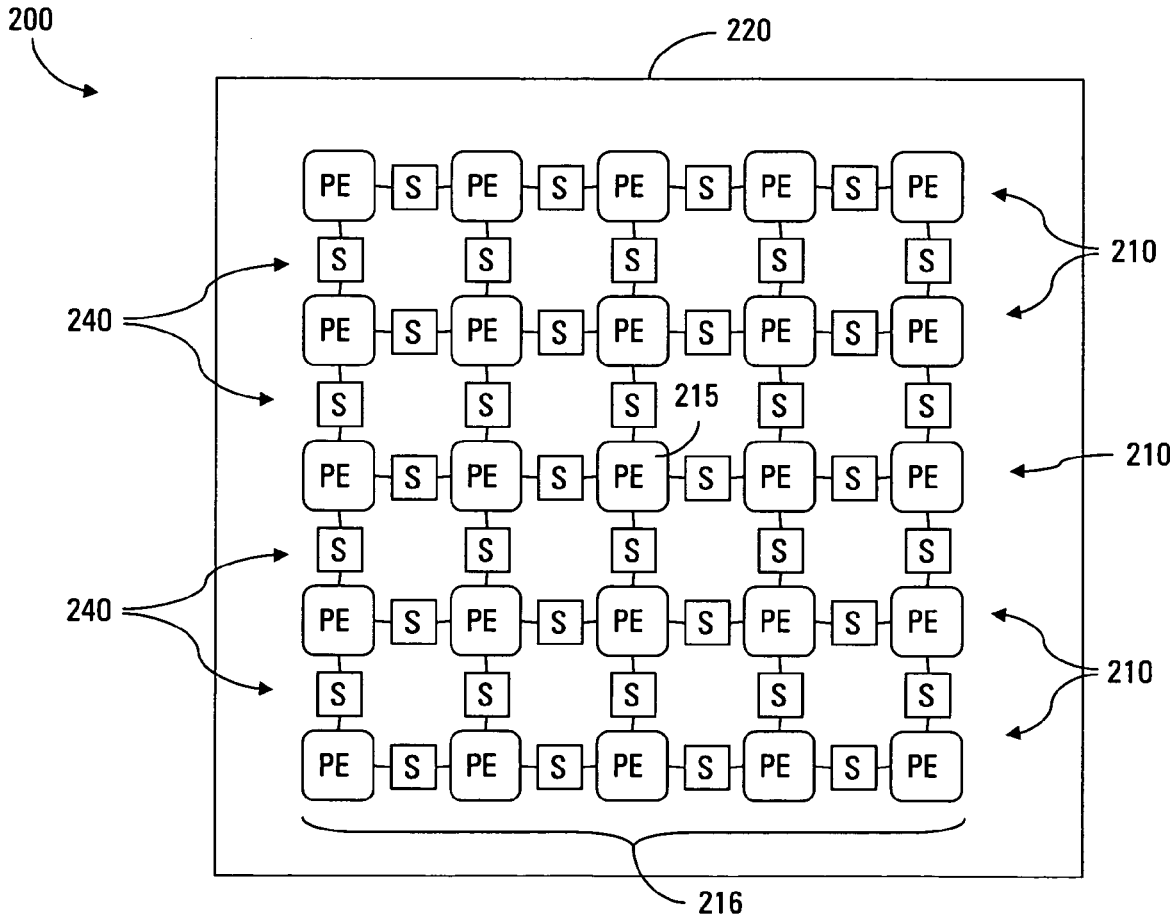
FIG. 2 is a block diagram of an embodiment of a reconfigurable antenna array.
Figure 3:
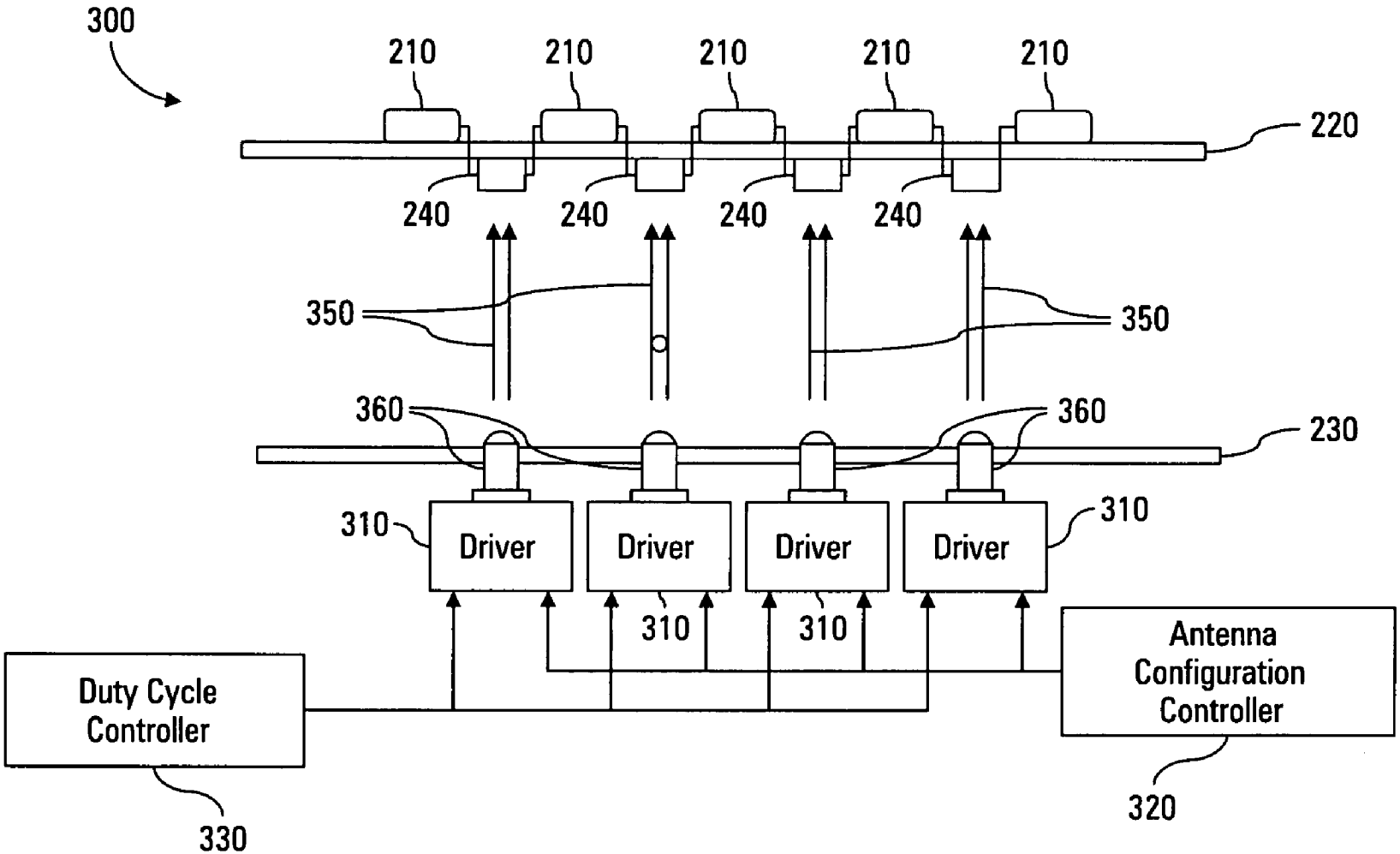
FIG. 3 is a block diagram of an embodiment of an electronics module of reconfigurable antenna array elements.

FIG. 2 is an example embodiment of a reconfigurable antenna array (aperture) 200 operable to provide the steerable antenna configuration patterns discussed herein. In the example embodiment of FIG. 2, the reconfigurable antenna array 200 represents at least one of the reconfigurable antenna arrays 104 of FIG. 1. The reconfigurable antenna array 200 comprises a matrix of metallic pad elements (PE) 210 arranged in an array 216. In one embodiment, pad elements 210 are mounted onto a printed circuit board 220. The printed circuit board 220 is suspended over a ground plane 230 to form an antenna, as illustrated in FIG. 3. The aperture 200 further comprises a plurality of switches (S) 240 which function to couple or decouple adjacent pad elements 210 together.

In operation, one of the pad elements 210 (for example, a center element 215) is driven by an electrical signal. By opening and closing one or more of the switches 240, the pattern in which current flows from the center element 215 through the pad elements 210 of the reconfigurable antenna array 200 is configured. In one implementation, the pattern of current flow is configured to create the steerable antenna configuration patterns, such as but not limited to a bent wire pattern and a spiral pattern, each with known radiation patterns. As illustrated in FIG. 3, the switches 240 are optically driven switches. In the example embodiment of FIG. 3, the optically driven switches 240 avoid the need for additional control wires located near the pad elements 210, which would tend to distort the radiation pattern of the aperture 200.

FIG. 3 is a block diagram of an embodiment of an electronics module 300 comprising the pad elements 210 of FIG. 2. The module 300 further comprises a plurality of light sources 360 each controlled by an associated driver 310. In one embodiment, the plurality of light sources 360 comprises vertical-cavity surface-emitting lasers (VCSELs), and the like. In one embodiment, the light sources 360 are embedded into the ground plane 230 and positioned to illuminate exactly one of the switches 240. In one embodiment, each driver 310 controls one of the light sources 360. An antenna configuration controller 320 is coupled to communicate the desired antenna array pattern to the drivers 310. In one embodiment, the antenna configuration controller 320 represents the antenna configuration controller 102 of FIG. 1. Based on the communicated antenna array pattern, each driver 310 will turn off one or more of switches 240 by turning on one or more of light sources 360. In one embodiment, a duty cycle controller 330 is also coupled to the drivers 310 to communicate a duty cycle signal to each of the drivers 310 for cycling light sources 360. For example, in one embodiment, the duty cycle controller 330 is coupled to an output enable pin of each driver 310.

In operation, for each switch 240 which should be in an ON state based on the antenna array pattern communicated from the antenna configuration controller 320, the drivers 310 will cycle the associated light sources 360 on (for time $t_1$) and off (for time $t_0$) as directed by the duty cycle controller 330. This is done in order to reduce the power consumption of the switch drivers without impacting switch performance. In one embodiment, the duty cycle controller 330 outputs a duty cycle signal comprising a square wave signal with a signal low for time $t_1$ and a signal high for time $t_0$. By duty cycling the light signals 350 from light sources 360 based on $t_1$ and $t_0$, a source voltage value ($V_s$) within each of the switches 240 that need to remain off in order to establish the desired antenna array pattern will be maintained above a minimum average light level required to activate each of the switches 240.

In the example embodiment of FIG. 3, the antenna configuration controller 320 is further operable to compare energy levels provided by the drivers 310 at each of the switches 240 configured to be in the ON state based on the antenna array pattern selected in the antenna configuration controller 320. For example, the antenna configuration controller 320 monitors the antenna array pattern programmed by the antenna steering module 104 to determine that the antenna array pattern as configured is substantially functional as the selected antenna array pattern.

Figure 4:
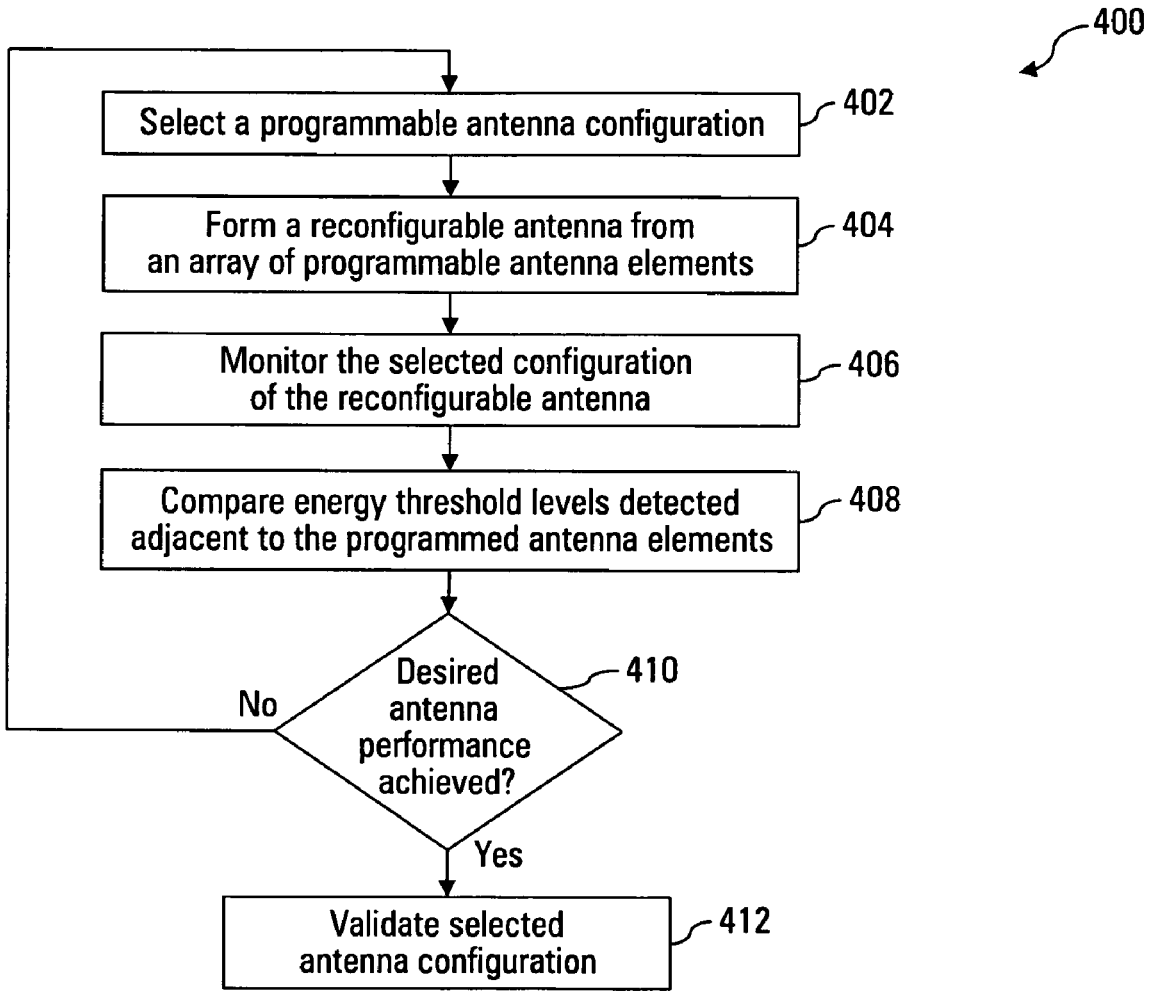
FIG. 4 is a flow diagram of a method of verifying programmable antenna configurations.

FIG. 4 is a flow diagram of a method 400 of verifying programmable antenna configurations, similar to the programmable antenna configurations available from the system 100 of FIG. 1. The method 400 addresses validating the formation of programmable antenna configurations by monitoring selected antenna configurations to determine antenna performance of at least one reconfigurable antenna. In one implementation, the method of FIG. 4 selects the programmable antenna configurations based on previously identified antenna configuration patterns (block 402). The selected programmable antenna configuration forms the at least one reconfigurable antenna from an array of programmable antenna elements (block 404). In one embodiment, the method 400 loads the selected programmable antenna configuration as at least one reconfigurable antenna steering pattern related to at least one of the previously identified antenna configuration patterns. Moreover, each of the programmable antenna configurations can be formed based on at least one signal beam pattern having known signal beam characteristics.

The method 400 monitors each of the selected antenna configurations by detecting a configuration state of the antenna array elements (block 406). In one implementation, the configuration state is indicative of an energy threshold level for configured array elements. The method 400 further compares the detected energy threshold levels at a plurality of switches adjacent to the configured array elements to determine that the programmable antenna configuration is substantially functional as the at least one reconfigurable antenna (block 408). To further validate the configured array elements, the method 400 evaluates each of the monitored antenna configurations based on the configuration of the switches selected to steer the reconfigurable antenna array elements in a desired signal beam direction (block 410). In one embodiment, the configuration is valid once the desired antenna performance is achieved (block 412).

The methods and techniques described here may be implemented in digital electronic circuitry, or with firmware or software in a programmable processor (for example, a special-purpose processor or a general-purpose processor such as a computer), or in combinations of them. An apparatus embodying these techniques may include appropriate input and output devices, a programmable processor, and a storage medium tangibly embodying program instructions for execution by the programmable processor. A process embodying these techniques may be performed by a programmable processor executing a program of instructions to perform desired functions by operating on input data and generating an appropriate output. The techniques may be implemented in one or more programs that are executable on a programmable system including at least one programmable processor coupled to receive data and instructions from, and to transmit data and instructions to, a data storage system, at least one input device, and at least one output device. Generally, a processor will receive instructions and data from a read-only memory (RAM) or a random access memory (ROM).

Storage devices suitable for tangibly embodying computer program instructions and data include all forms of non-volatile memory, including by way of example semiconductor memory devices, such as (electrically) erasable programmable read-only memory (EPROM or EEPROM), and flash memory devices; magnetic disks such as internal hard disks and removable disks; and magneto-optical disks, including but not limited to digital video disks (DVDs). Any of the foregoing may be supplemented by, or incorporated in, specially-designed application-specific integrated circuits (ASICs), and the like.

This description has been presented for purposes of illustration, and is not intended to be exhaustive or limited to the embodiments disclosed. Variations and modifications may occur, which fall within the scope of the following claims.

What is claimed is:

1. A method of verifying programmable antenna configurations, the method comprising:

selecting a desired antenna configuration pattern from a plurality of antenna configuration patterns;

issuing commands to an array of antenna element switches coupled to a plurality of reconfigurable antenna elements, wherein the commands cause the array of antenna element switches to switch to programmed positions causing the reconfigurable antenna array elements to form the desired antenna configuration pattern;

monitoring actual positions of the array of antenna element switches; and verifying that the actual positions of the array of antenna element switches match the programmed positions of the array of antenna element switches.

2. The method of claim 1 and further comprising selecting the desired antenna configuration pattern based on at least one antenna radiation pattern having known signal beam characteristics.

3. The method of claim 1, wherein selecting the desired antenna configuration pattern further comprises loading at least one reconfigurable antenna steering pattern related to at least one of the plurality of antenna configuration patterns.

4. The method of claim 1, further comprising monitoring a configuration state of the reconfigurable antenna array elements that form the desired antenna configuration pattern, the configuration state indicative of an energy threshold level for the reconfigurable antenna array elements.

5. The method of claim 4, wherein monitoring the configuration state of the reconfigurable antenna array elements comprises evaluating the desired antenna configuration pattern based on the actual positions of the array of antenna element switches.

6. The method of claim 5, wherein evaluating the desired antenna configuration pattern further comprises comparing energy levels at a plurality of antenna element switches adjacent to the reconfigurable antenna array elements to determine that the desired antenna configuration pattern is substantially functional as a reconfigurable antenna.

7. An antenna configuration controller for antenna configuration pattern verification, comprising:

an antenna pattern generation module operable to provide a plurality of antenna configuration patterns; and an antenna steering module in communication with the antenna pattern generation module, the antenna steering module operable to load at least one of the antenna configuration patterns on a reconfigurable antenna array having an array of antenna element switches coupled to a plurality of reconfigurable antenna elements by causing the array of antenna element switches to switch to programmed positions causing the reconfigurable antenna array elements to form the desired antenna configuration pattern;

wherein the antenna steering module is further operable to verify that actual positions of the array of antenna element switches match the programmed positions of the array of antenna element switches of the reconfigurable antenna array.

8. The controller of claim 7, wherein the antenna configuration controller is operable to monitor the at least one antenna configuration pattern formed on the reconfigurable antenna array.

9. The controller of claim 7, wherein the antenna configuration controller is operable to receive one or more antenna configuration input commands.

10. The controller of claim 7, wherein the antenna configuration controller comprises at least one of a microprocessor, a microcontroller, a field-programmable gate array, a field-programmable object array, a programmable logic device, or an application-specific integrated circuit.

11. The controller of claim 7, wherein the antenna pattern generation module further comprises a memory module.

12. The controller of claim 11, wherein the memory module is operable to store each of the antenna configuration patterns with a corresponding switching pattern for the reconfigurable antenna array.

13. The controller of claim 7, wherein the antenna steering module further includes an antenna steering verification module.

14. The controller of claim 13, wherein the antenna steering verification module is operable to verify that the actual positions of the array of antenna element switches match the programmed positions of the array of antenna element switches of the reconfigurable antenna array.

15. The controller of claim 13, wherein the antenna steering verification module is operable to detect configuration states of the reconfigurable antenna elements, the configuration states indicative of energy threshold levels for configured reconfigurable antenna elements.

16. The controller of claim 13, wherein the antenna steering verification module is further operable to compare energy levels at a plurality of antenna element switches adjacent to the configured reconfigurable antenna elements to determine that the desired antenna configuration pattern is substantially functional as the at least one reconfigurable antenna.

17. A computer program product comprising program instructions, embodied on a non-transitory machine-readable storage medium, the program instructions cause at least one programmable processor of an antenna configuration pattern verification system to:

receive configuration commands to form at least one desired antenna configuration pattern using a reconfigurable antenna array;

issue commands to an array of antenna element switches coupled to a plurality of reconfigurable antenna elements in the reconfigurable antenna array, wherein the commands cause the array of antenna element switches to switch to programmed positions causing the reconfigurable antenna array elements to form the desired antenna configuration pattern;

monitor actual positions of the array of antenna element switches; and verify that the actual positions of the array of antenna element switches match the programmed positions of the array of antenna element switches.

18. The computer program product of claim 17, wherein the desired antenna configuration pattern is configured to provide a prescribed signal beam characteristics for an antenna signal beam output at a desired frequency.

19. The computer program product of claim 17, further comprising program instructions that cause the at least one programmable processor to detect a configuration state of the reconfigurable antenna array elements, the configuration state indicative of an energy threshold level.

20. The computer program product of claim 19, wherein the program instructions that detect the configuration state of the reconfigurable antenna array elements cause the at least one programmable processor to compare energy levels at a plurality of antenna element switches adjacent to the reconfigurable antenna array elements to verify that an antenna signal beam output is substantially functional for the at least one desired antenna configuration pattern.

* * * * *